United States Patent [19]

Warncke et al.

[11] 4,213,453

[45] Jul. 22, 1980

[54] BREATHING DEVICE HAVING OXYGEN DONOR CHEMICAL CARTRIDGE

[75] Inventors: Ernst Warncke, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 868,740

[22] Filed: Jan. 12, 1978

[30] Foreign Application Priority Data

Jan. 20, 1977 [DE] Fed. Rep. of Germany ..... 2702192

[51] Int. Cl.[2] ..... A62B 7/08

[52] U.S. Cl. ..... 128/202.26; 128/205.17; 128/205.28

[58] Field of Search ..... 128/191 R, 142 R, 142.2, 128/142.3, 142.4, 142.5, 142.6, 142.7, 146.6, 147, 202, 188, 140 R, 203; 55/312, 418, DIG. 33, DIG. 35, 482, 286, 387

[56] References Cited

U.S. PATENT DOCUMENTS

| | | | |
|---|---|---|---|
| 3,326,212 | 6/1967 | Phillips | 128/202 |
| 3,794,030 | 2/1974 | Cotabish et al. | 128/202 |
| 3,980,081 | 9/1976 | Cotabish et al. | 128/202 X |
| 4,154,236 | 5/1979 | Eckstein et al. | 128/191 R |

FOREIGN PATENT DOCUMENTS

| | | | |
|---|---|---|---|
| 208565 | 4/1909 | Fed. Rep. of Germany | 128/191 R |

*Primary Examiner*—Henry J. Recla

*Attorney, Agent, or Firm*—McGlew and Tuttle

[57] ABSTRACT

A breathing device to facilitate a person's respiratory breathing of air with sufficient oxygen, comprises a breathing conduit adapted to be connected to a person for breathing. A breathing bag surrounds a portion of the conduit and it is connected into the conduit through suitable check valve elements to permit respiratory breathing along the conduit and from and to the bag. A first chemical cartridge has a first housing with an opening therethrough through which the conduit extends and it has an oxygen-liberating chemical therein which surrounds and is spaced radially outwardly from the conduit. An annular passage is defined in the space between the chemical and the conduit which communicates with the bag. The conduit has an end adjacent the bottom end of the first cartridge which is connectable to a central tube of a second chemical cartridge. The central tube has an end portion which interengages with the bottom end portion of the first conduit. The tubular conduit portion of the second chemical cartridge housing is spaced from the bottom end of the housing and respiratory air may circulate downwardly from the breathing conduit through the tubular central portion of the second chemical cartridge and back upwardly through the oxygen-liberating chemical which is contained in the second cartridge. The second chemical cartridge functions as a spare or an additional cartridge and the construction is such that the initial cartridge may be continued to be used while the second cartridge is cut into the breathing conduit line.

7 Claims, 4 Drawing Figures

BREATHING DEVICE HAVING OXYGEN DONOR CHEMICAL CARTRIDGE

FIELD AND BACKGROUND OF THE INVENTION

This invention relates to breathing devices in general and, in particular, to a new and useful breathing device having an oxygen donor chemical cartidge.

DESCRIPTION OF THE PRIOR ART

In breathing equipment having a solid oxygen based type of oxygen donor chemical cartridge, oxygen is produced by the oxygen-containing chemical reacting with the moisture and carbon dioxide in the exhaled air or it proceeds automatically following an ignition. With the chemical cartridge present in the equipment, the operating time is limited. However, it can be prolonged by the additional coupling of a larger sized chemical cartridge.

A known oxygen respirator unit which can be used both by way of circulating inhaled air and by pendulum breathing, is equipped with a carbonic acid compount containing oxygen donor cartridge, which can be interchanged during unit operation. The cartridge jacket is provided with inlet and outlet openings facing each other. It is gas leak-proof and it is supported by a bearing. After use under uninterrupted unit operational conditions with gas-proof sealed connector openings, it can be replaced by a new cartridge which is slid in directly after it. The bearing may consist of a tubular external receptacle open at both ends or of two interfaced concave shells which are attached at a bearing plate. At least one of the shells is pressed under spring load against the cartridge jacket. In this breathing apparatus, the sealing of a cartridge into the long bearing in which almost two cartridges must axially be accommodated one behind the other is not simple. Under rough operating conditions for which these units are provided, there is always a chance that dirt accumulations will prevent a sliding exchange. In addition, there is no guarantee that the cartridge is used up to its full extent. See German Pat. No. 650,830.

A further known inhaled-air circulation type operating oxygen respirator unit contains an interchangeable air cleaner cartridge in which carbonic acid is absorbed and oxygen is developed in a conventional manner. During operation with the air cleaner cartridge connected, the inhaled air is fed via the cartridge to an air bag and from there it is directly breathed in again. The air cleaner cartridge has concentrically arranged air inlet and outlet openings, by which it is switched into the breathing air circulation via a socket coupling nad a valve arrangement of two spring-loaded valve shutter bodies nestling in each other.

Upon removal of the cartridge, the socket coupling is closed to the outside but the passage for exhaling by the carrier into the air bag is opened. Despite the complex-developed coupling with the valves, an exchanging of used up cartridges creates a dangerous moment for the wearer. During this time, he can only breathe out of the air bag, with the inhaled air content thereof being exhausted after only a few breaths. The exchange of air cleaner cartridges, therefore, must be well prepared and must even then be executed in a perfect manner. Under emergency conditions, this cannot fail to be a problem. See German Pat. No. 1,209,434.

SUMMARY OF THE INVENTION

The present invention prolongs the operating time in breathing equipment having an oxygen donor chemical cartridge by the coupling of an additional chemical cartridge, without endangering the wearer during coupling by a breakdown in the breathing gas supply.

In accordance with the invention, the breathing apparatus includes a breathing line which extends through the center of a first chemical cartridge to define an annular flow space around the breathing line for the circulation of breathing air along with liberated oxygen from the chemical cartridge into suitable check means provided in the breathing line. In addition, a second cartridge has a tubular central portion which is connectable to the tubular conduit to form an extension thereof so that the second cartridge may be immediately connected into the breathing line to supply oxygen thereto even while the first cartridge chemical continues to supply oxygen.

The advantages obtained by the present invention reside specifically in the fact that the user, during his normal acitivity, where he carries with him only the breathing equipment, but does not use it, does not have a large load to carry. For its initial use, the breathing equipment is of a small size and is therefore a lightweight chemical cartridge and it supplies full breathing protection, although for only a limited time. To extend the operating time, a large size booster chemical cartridge is hooked up with the smaller chemical cartridge without endangering the safety of the wearer. The booster chemical cartridges are stored at locations known to the wearer and are accessible there in catastrophic cases. The engineering design of connecting the booster chemical cartridge to the breathing equipment is both simple and safe. Both required seals are constructed without any difficult double fitting. The opportunity of breathing during the coupling process is thus uninterrupted. The booster chemical cartridge can be increased in size so that the operating time can be extended to any given point.

By additionally equipping the breathing unit and the chemical cartridge with check valves, various air ducts are feasible, which facilitate adaptations required for applicable cases in an advantageously simple manner. In this case, a user, e.g., in whose district, sharp elevation differentials must be overcome, can afford to purchase valves for somewhat more complex units for reducing breathing blockages or for a chance to breathe in air bag cooled air.

With embodiments according to the invention, the breathing equipment chemical cartridge following its coupling to the booster chemical cartridge is bypassed. In this way, the risen resistance value drops at least to its initial value. A complete using up of the chemical cartridge is ensured by a still low through-flow.

Accordingly, it is an object of the invention to provide an improved breathing apparatus which includes a cartridge with an oxygen-liberating chemical which is connected to a breathing line and which also includes means for coupling and interconnecting a second spare cartridge to the breathing line for use in addition to or during the use of the first cartridge.

A further object of the invention is to provide a breathing device having oxygen donor chemical cartridge which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
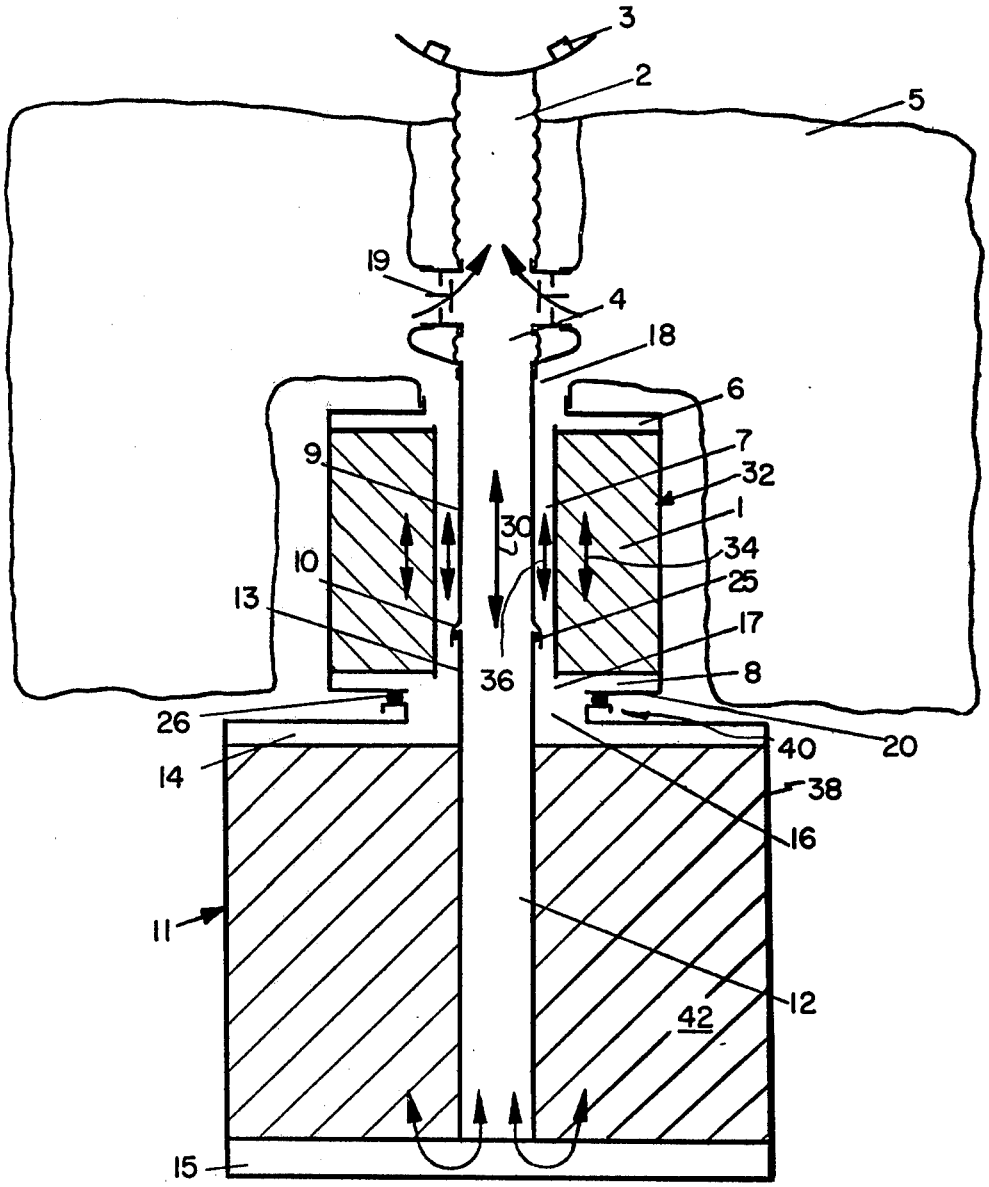
FIG. 1 is a somewhat schematic partial sectional view of a breathing device constructed in accordance with the invention.

Referring to the drawings in particular, the invention embodied therein, comprises a breathing apparatus which includes a mouthpiece which is adapted to be engaged by a wearer of the device which is connected to an air hose 2 and to a breathing conduit or central tube 9 for the circulation of respiratory air in the direction of the arrows indicated at 30.

In accordance with the invention, the breathing apparatus includes an air bag 5 adjacent the breathing conduit 9 which is connected interiorally through suitable check valve means 19 to the interior of the breathing conduit and air hose 2. A first chemical cartridge, generally designated 32, contains an oxygen-liberating chemical 1 which supplies oxygen into a ring channel or annular space 7 between the interior of chemical 1 and the exterior of breathing conduit 9. Oxygen which is liberated from the chemical may evolve from a hollow bottom space 8 in the bottom of a housing 6 for the first chemical cartridge 32 and flow may be in the direction of the double arrows indicated at 34 and 36 for the purpose of adding oxygen to the breathed air into bag 5 and then into the interior of the breathing conduit 9 to the air hose 2.

In accordance with a further feature of the invention, a second chemical cartridge or booster chemical cartridge, generally designated 11, includes a housing 38 with coupling means, generally designated 40, for facilitating its instant connection to the housing of the chemical cartridge 32. For this purpose, the coupling 40 includes a gasket 26 to tightly seal the parts together. In addition, the booster chemical cartridge 11 contains a central tube portion 12 having an upper end defining a male socket connection 13 fitting into a female socket connection 10 of the breathing tube 9.

The breathing equipment according to FIGS. 1 through 4 comprises a carbonic acid bond, oxygen donor type chemical cartridge 1, to which the air hose 2 with the mouthpiece 3 is connected via air connector 4. Chemical cartridge 1 contains the central breathing tube 9, which allows for a free through-flow as does the ring channel 7 arranged between central tube 9 and the fitting. The central breathing tube 9 ends below in socket 10, in which connector sleeve 13 of tube 12 of booster chemical cartridge 11 is inserted. A seal is provided by a gasket 25. Simultaneously, the hollow space 14 above the filling of booster chemical cartridge 11 is connected to hollow space 8 via connection opening 16, gasket 26 and opening 17 in bottom 20. The tube 12 is connected to hollow space 15 beneath the filling 42 of booster chemical cartridge 11.

Figure 2:
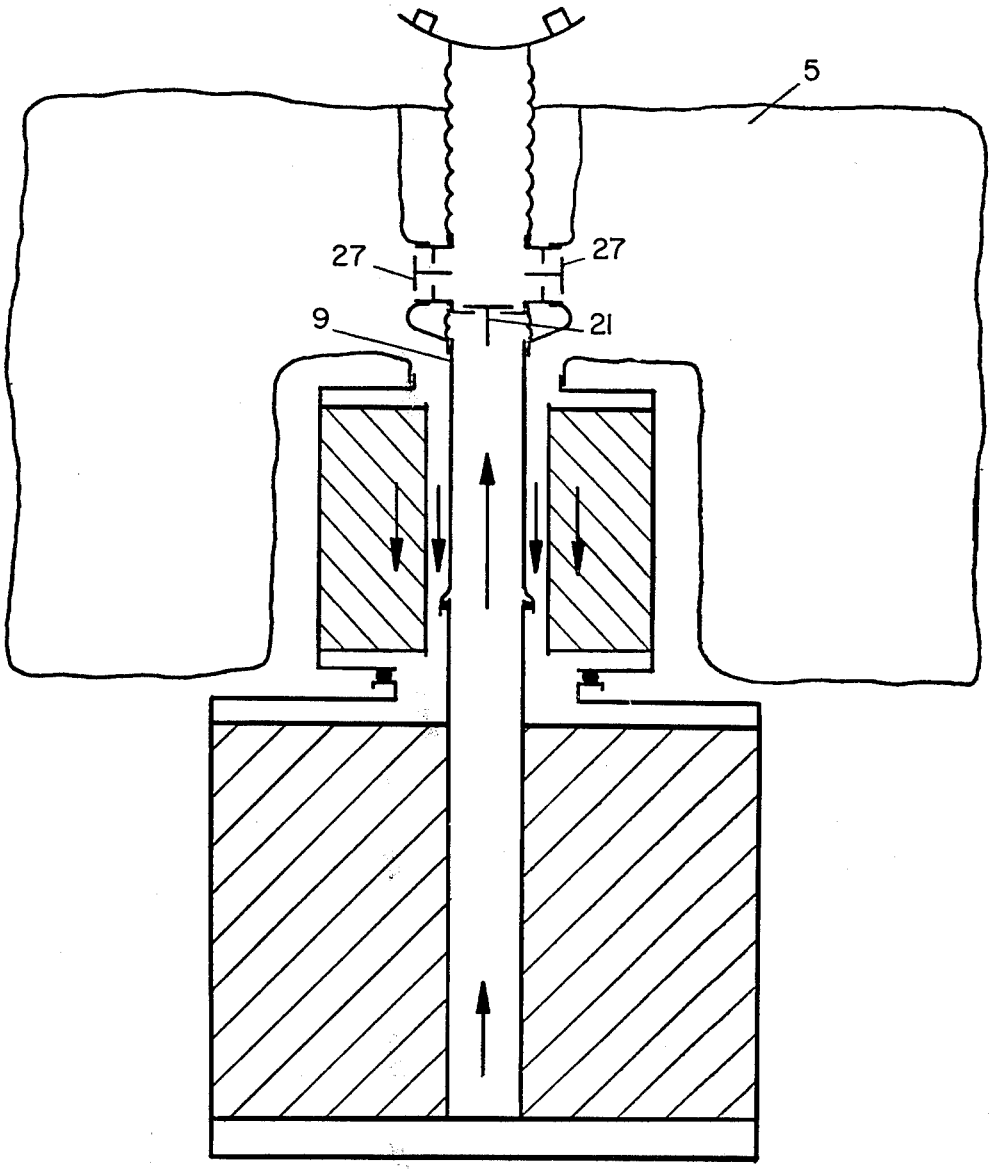
FIG. 2 is a view similar to FIG. 1 of another embodiment of the invention.

In the design according to FIGS. 1 and 2, air bag 5 is connected to hollow space 6 above the filling of chemical cartridge 1 and to ring channel 7 via ring opening 18. It is furthermore connected to breathing air connector 4 via check valves 19 as shown in FIG. 1 and/or 27, as shown in FIG. 2.

Figure 3:
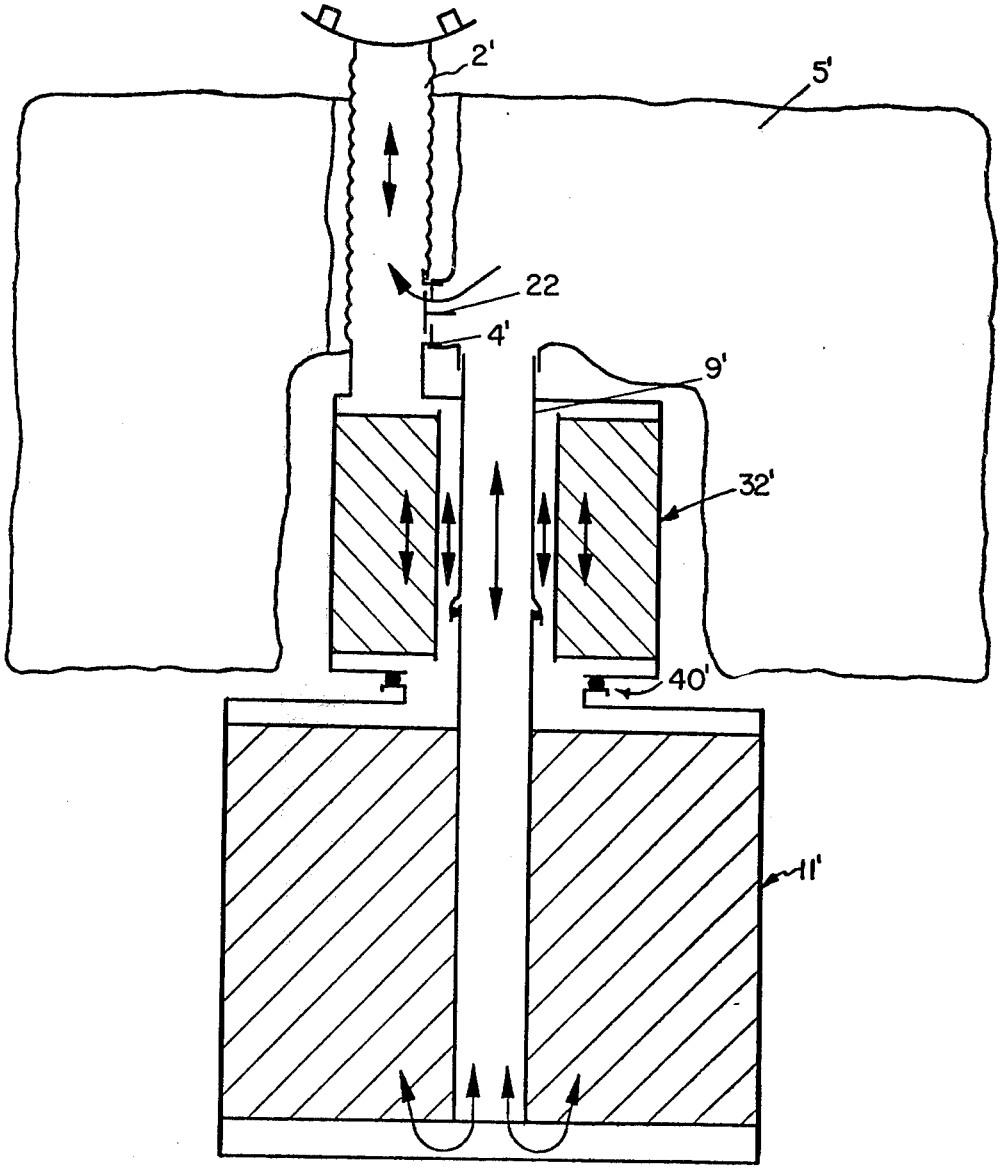
FIGS. 3 and 4 are views similar to FIG. 1 of still other embodiments of the invention.
Figure 4:
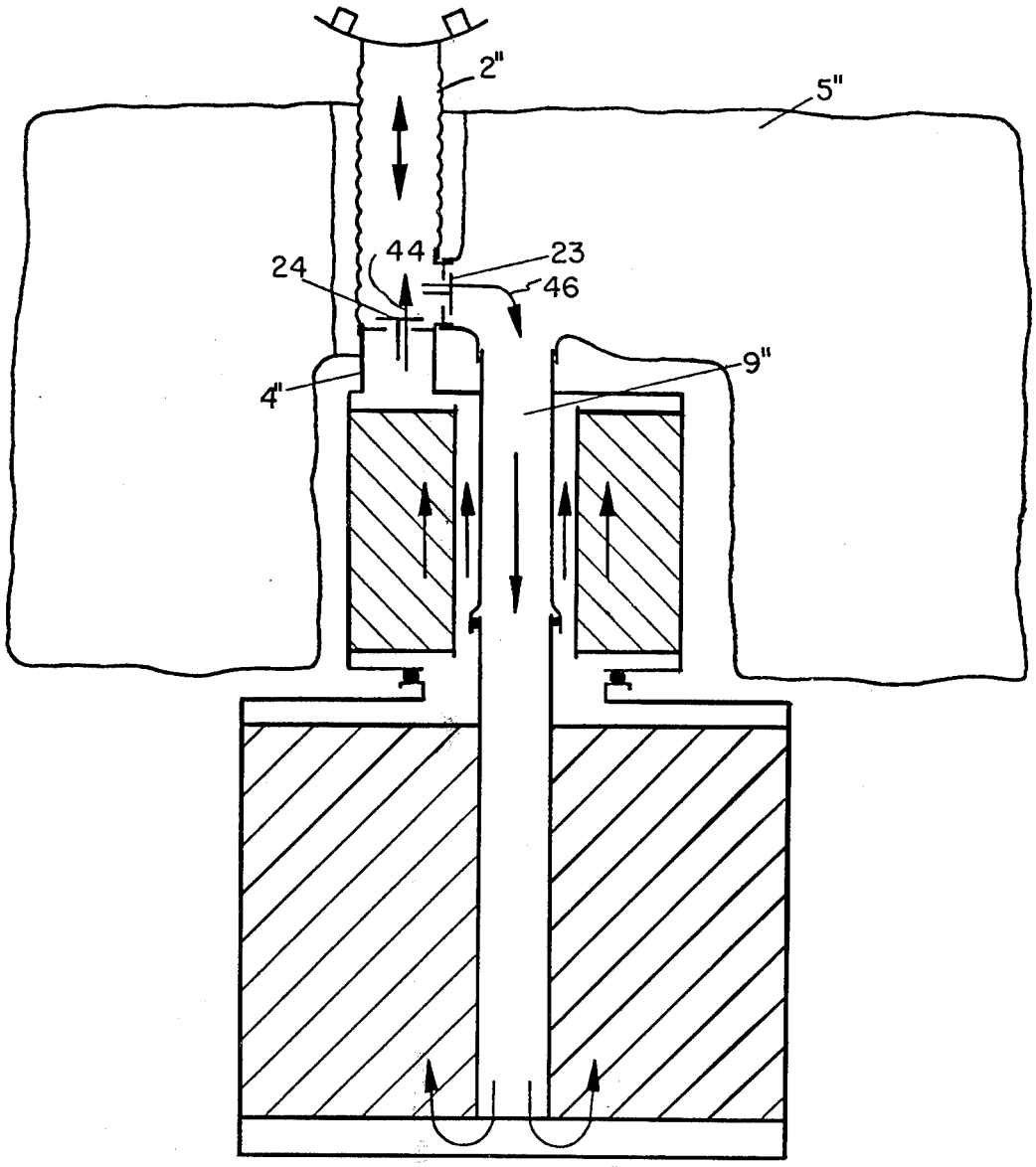

In the design according to FIGS. 3 and 4, air bag 5′ is connected to central tube 9′, and to air connector 4′ via check valves 22 and 23. Following its coupling to chemical cartridge 32′, the booster chemical cartridge 11′ is kept in the coupling position by mechanical coupling elements 40′. These can include known spring-loaded latches, clamping levers, screw locks or the like (not shown). In these embodiments the breathing conduit is formed by tube 9′ or 9″ with hoses 2′ or 2″, and their respective connections. The breathing conduit thus, in all the embodiments, comprises a first portion represented by hoses 2, 2′ or 2″ and a second portion represented by the tubes 9, 9′ and 9″.

In all of the embodiments of the invention, the chemical cartridge 1 of the breathing equipment following the coupling of booster chemical cartridge 11 is substantially bypassed. Thus, the again reduced breathing air resistance is determined by the booster chemical cartridge. The parallel current, which continues to flow through until the complete using up by chemical cartridge 32′ of the chemical filling, ensures a complete utilization of the chemical.

With the design, according to FIG. 1, the flow-through of chemical cartridge 1 following the coupling of booster chemical cartridge 11 is practically bypassed in both the exhaled and inhaled phase by central tube 9 and ring channel 7. The cartridge 11, which on respiration only with chemical cartridge 1 alone, is still sealed on the bottom with a film, is open on coupling. The exhaled air then arrives at air bag 5 via mouthpiece 3, air hose 2, central tube 9, tube 12, the filling of booster chemical cartridge 11 and ring channel 7, from where the breathing air, then in the inhaled phase, flows into the breathing passages of the equipment carrier again via check valves 19, air hose 2 and mouthpiece 3. The resistance of used-up chemical cartridge 1 is eliminated by way of ring channel 7, which produces practically no flow losses.

By comparison with the construction according to FIG. 1, the construction according to FIG. 2 has check valves 27, and additionally, at air connector 4′, a check valve 21, closing against central tube 9′ is included. This construction of FIG. 2 then has its through-flow reversed from that of FIG. 1. Under special conditions, this can be more favorable in a breathing-physiological sense.

With further relation to the design according to FIG. 1, the design according to FIG. 3 has a connection for air bag 5′ directly to central tube 9′ and, therefore, requires only a check valve 22 for inhaling.

With a design according to FIG. 4, check valves 23 and 23 prevent flow between the air bag 5″ and breathing tube 9″ and hose 2″ and fitting 4″ as shown by arrows 44 and 46.

While specific embodiments of the invention have been shown and described in detail to illustrate the application of the principles of the invention, it will be understood that the invention may be embodied otherwise without departing from such principles.

What is claimed is:

1. A breathing device to facilitate a person's respiratory breathing of air with sufficient oxygen, comprising a breathing conduit adapted to be connected to a person, a breathing bag adjacent said breathing conduit, check valve means connecting said breathing bag to a first portion of said conduit for outflow of breathing air from said bag to said first portion of said conduit, a first chemical cartridge having a housing with an opening therethrough through which a second portion of said conduit extends, said first chemical cartridge having an oxygen-liberating chemical therein surrounding and spaced radially outwardly of said second portion of said conduit extending through said opening and defining an annular passage, said conduit having an end terminating adjacent the bottom of said first chemical cartridge, a second chemical cartridge having a cylindrical housing with a top access opening a tubular central portion extending through said access opening into said second chemical cartridge housing, a second oxygen-liberating chemical in said second chemical cartridge housing surrounding said tubular conduit portion, said tubular conduit portion and said second oxygen-liberating chemical being spaced from the bottom of said second chemical cartridge housing, and coupling means coupling said tubular conduit portion to said breathing conduit and said access opening of said second chemical cartridge housing to said through-opening of said first chemical cartridge housing.

2. A breathing device, as claimed in claim 1, wherein said check valve means comprises a valve connection between said bag and said breathing conduit having a check valve opening inwardly into said breathing conduit.

3. A breathing device, as claimed in claim 1, wherein the upper end of said breathing conduit second portion opens into said bag, an air hose defining said first portion of said breathing conduit connected into said annular passage of said first chemical cartridge, said check valve means including a check valve opening inwardly into said air hose.

4. A breathing device to facilitate a person's respiratory breathing of air with sufficient oxygen, comprising a breathing conduit adapted to be connected to a person, a breathing bag adjacent said breathing conduit, check valve means connecting said breathing bag to a first portion of said conduit for inflow of breathing air to said bag from said first portion of said conduit, a first chemical cartridge having a housing with an opening therethrough through which a second portion of said conduit extends, said first chemical cartridge having an oxygen-liberating chemical therein surrounding and spaced radially outwardly of said second portion of said conduit extending through said opening and defining an annular passage, said conduit having an end terminating adjacent the bottom of said first chemical cartridge, a second chemical cartridge having a cylindrical housing with a top access opening a tubular central portion extending through said top access opening into said second chemical cartridge housing, a second oxygen-liberating chemical in said second chemical cartridge housing surrounding said tubular conduit portion, said tubular conduit portion and said second oxygen-liberating chemical being spaced from the bottom of said second chemical cartridge housing, and coupling means coupling said tubular conduit portion to said breathing conduit and said access opening of said second chemical cartridge housing to said through-opening of said first chemical cartridge housing.

5. A breathing device, as claimed in claim 1, wherein said breathing conduit includes an air connector portion and a breathing hose connected to the outer end of said air connector portion and terminating in an end engageable with the user, said air bag surrounding said air connector portion and a portion of said air hose, said check valve means including a passage between said air hose and said air bag and a check valve openable outwardly into said bag from the interior of said air hose.

6. A breathing device, as claimed in claim 1, wherein said breathing conduit includes an air hose portion connected into the top of said first chemical cartridge and a portion extending through said first chemical cartridge and into said breathing bag, said check valve means including a first check valve opening into said bag from said air hose portion and a second check valve opening into said air hose portion from said first chemical cartridge.

7. A breathing device, as claimed in claim 4, wherein the upper end of said breathing conduit second portion opens into said bag, an air hose defining said first portion of said breathing conduit connected into said annular passage of said first chemical cartridge, said check valve means including a check valve opening inwardly into said bag.

* * * * *